US005487617A

United States Patent [19]

Cole et al.

[11] Patent Number: 5,487,617

[45] Date of Patent: Jan. 30, 1996

[54] HANGING FILE SYSTEM AND APPARATUS

[76] Inventors: Josephine A. Cole, 2034 N. 49th St., Milwaukee, Wis. 53208; Kenneth J. Muderlak, 4481 N. Maryland Ave., Shorewood, Wis. 53211

[21] Appl. No.: 199,549

[22] Filed: Feb. 22, 1994

[51] Int. Cl.[6] ..... B42D 15/00; B42F 15/00

[52] U.S. Cl. ..... 402/4; D19/90; 229/67.2; 229/69; 40/617; 206/806; 211/113; 402/79

[58] Field of Search ..... 402/79, 4; D19/90; 229/67.2, 69; 206/425, 806; 40/617; 312/184; 211/113, 45, 46

[56] References Cited

U.S. PATENT DOCUMENTS

| | | | |
|---|---|---|---|
| D. 347,447 | 5/1994 | Isserstedt | D19/90 |
| 2,816,379 | 12/1957 | Ensor | 40/124.2 X |
| 4,706,396 | 11/1987 | Nomura . | |
| 4,749,090 | 6/1988 | Darmanin | 21/113 X |
| 5,083,663 | 1/1992 | Conway et al. | 211/113 X |
| 5,163,606 | 11/1992 | Isserstedt | 229/67.2 |

FOREIGN PATENT DOCUMENTS

| | | | |
|---|---|---|---|
| 2432941 | 4/1980 | France | 206/425 |

*Primary Examiner*—Frances Han

*Attorney, Agent, or Firm*—Michael, Best & Friedrich

[57] ABSTRACT

The downwardly opening hooks of the front and back upper corners of the hanging files are connected to support members slideably mounted on a flexible wire which has stops mounted thereon to position each file relative to the others. The handle mounted on the wire eases carrying the files and serves as the hanging point when the file are hung on a wall or the like. When so hung the files are vertically spaced in an overlapping manner facilitating access to the files and visual determination of the contents. The files can be supported in the usual file cabinet in the usual manner. The wire does not interfere with such use.

6 Claims, 3 Drawing Sheets

HANGING FILE SYSTEM AND APPARATUS

This application relates to hanging files having enhanced utility.

BACKGROUND OF THE INVENTION

Hanging file systems support the files in file drawers. The files may be removed for use but at that time the files are likely to get out of order, etc., and the contents become difficult to ascertain.

BRIEF SUMMARY OF THE INVENTION

The upper corners of the typical hanging file have a downwardly opening hook-like suspension device which can be mounted on rods mounted in a file drawer or they can be mounted directly on the sides of the drawer. The present invention increases the utility of the files by flexibly interconnecting the files and providing for hanging them in a vertically spaced but overlapping arrangement making all the files readily visible and accessible. The files may be hung flat against a wall in a vertically overlapping manner or can be supported in the usual file drawer or the like or transported in a briefcase or the like to be hung for display at another destination. This invention is applicable to files of the type having accordion-fold sides and only one suspension device for each upper corner of the file as well as the more usual arrangement having a hook or similar device at the upper corners of both the front and the back of the file. The flexible interconnection on the files is preferably effected by flexible wire having stops thereon serving to position the files. When the files are returned to the file drawer the wire does not get in the way and does not have to be removed. Thus the assembly can be lifted from the file drawer and carried to the point of hanging by means of the wire.

The wire is provided with a central centering device in the form of an inverted V which also serves as a carrying handle. The wire exerts a force component on the upper corners tending to push the corners towards each other which would render the upper file useless. Therefore, the upper file is provided with a rigid spacer to prevent movement of the corners towards each other. As an alternative, the handle can be made integral with the rigid spacer but this does not do away with the flexible wire which interconnects the files.

DETAILED DESCRIPTION OF THE DRAWINGS

Figure 2:
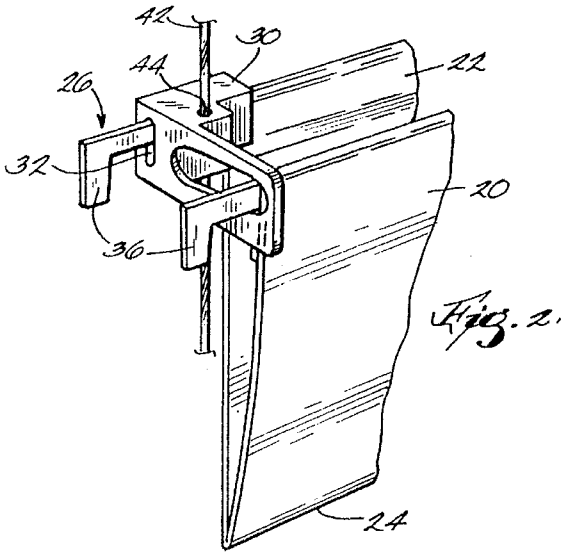
FIG. 2 is an enlarged perspective view of an upper left corner of a file showing the manner in which the front and rear hooks are interconnected by a support member which allows separation of the front and rear panels but causes the front panel to move towards the rear panel in response to a load in the file.

The hanging or pendant files 10, 12, 14, 16, 18 shown in the drawings are the type made of a heavy paper stock folded to provide front and rear panels 20,22 respectively, interconnected at the fold 24. The upper corners of the panels are provided with downwardly opening hooks 26 which are adapted to be supported on rails 28 in a file cabinet (not shown). The ends or sides of the files are open but the files could be the type having closed ends in which case only one hook would be necessary for each pair of upper corners. This invention would still be applicable to such files.

Figure 3:
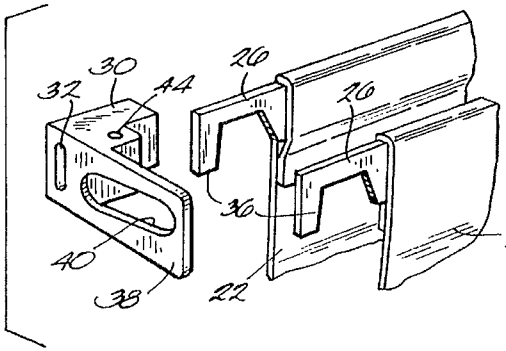
FIG. 3 is an exploded perspective similar to FIG. 2 but illustrating the manner in which the hooks engage the support member.
Figure 4:
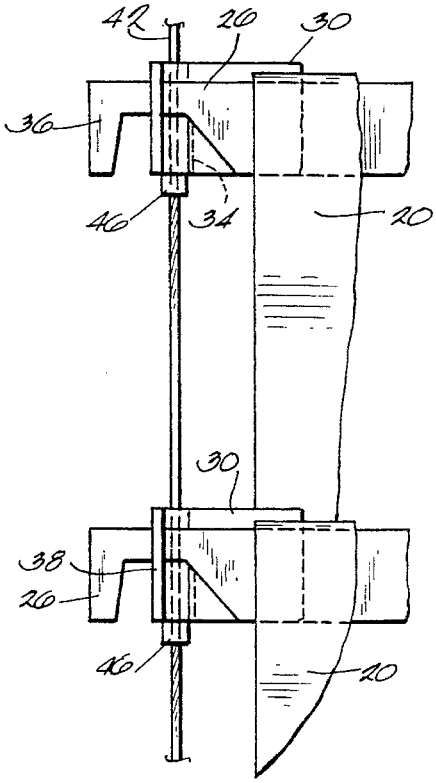
FIG. 4 is an enlarged detail of the manner in which the files are vertically spaced on the wire.
Figure 5:
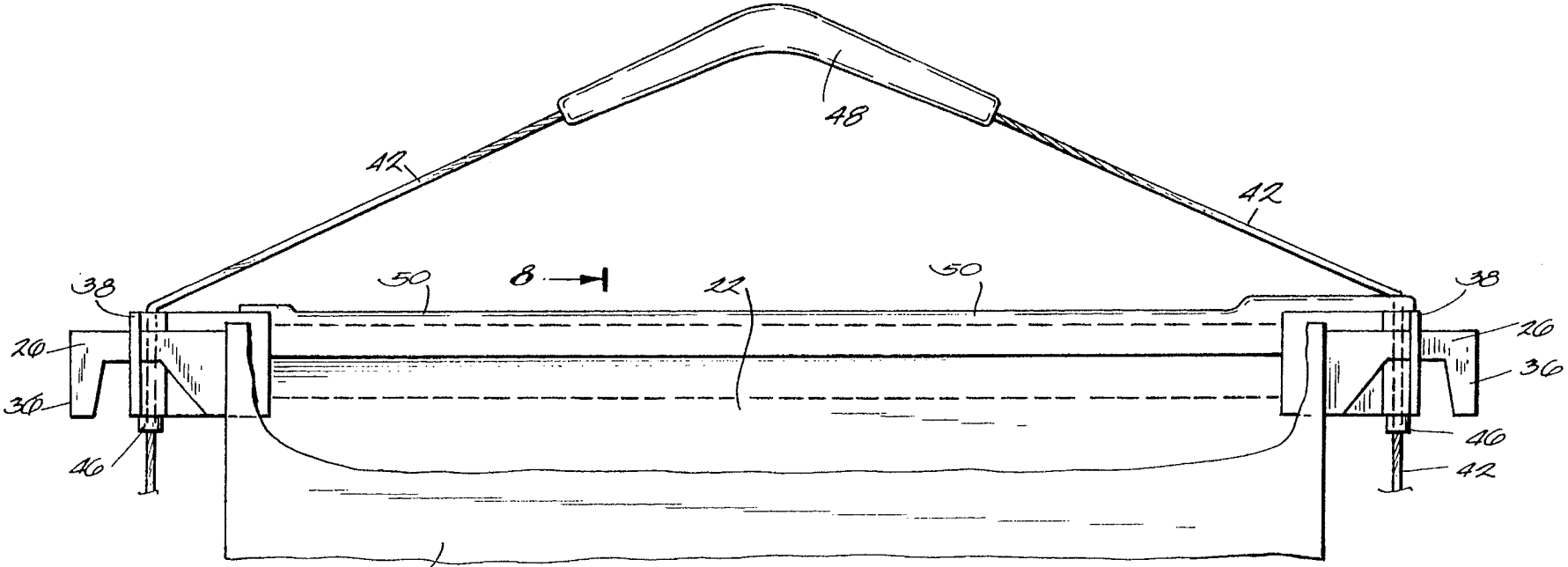
FIG. 5 shows the rigid stiffener on the top edge of the rear file panel to prevent bending the panel.
Figure 8:
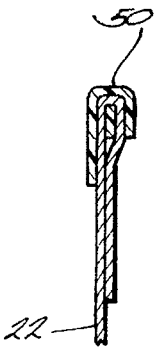
FIG. 8 is a section taken in line 8—8 in FIG. 5.

The present invention contemplates the use of support members 30 to interconnect the front and rear hooks at the uppers corners of the files. The support members are the same for each end of the file . . . the members are simply turned over at one end relative to those at the other end of the file. As can be seen in FIGS. 2 and 3 in particular, the support member 30 has a rear, block-like portion having a slot 32 through which a rear hook 26 extends. In FIG. 4 the dotted line 34 indicates the extent of the slot 32 opening in the right side of the blocklike portion. The vertical extent of the slot 32 is limited and the horizontal extent of the slot opening is sufficient so as to enable the large end 36 of the hook 26 to be turned to pass through the slot prior to assuming its normal disposition in FIG. 2 where the head 36 is obviously larger than the slot 32 and prevents withdrawal of the hook without manipulating the hook again. The support 30 includes a forwardly projecting arm 38 provided with an upwardly inclined slot 40 through which the front hook 26 is mounted with manipulation to get the head 36 through the slot. The weight of the file contents will downwardly load the front hook so it will slide down the slot 40 to close the file.

Figure 1:
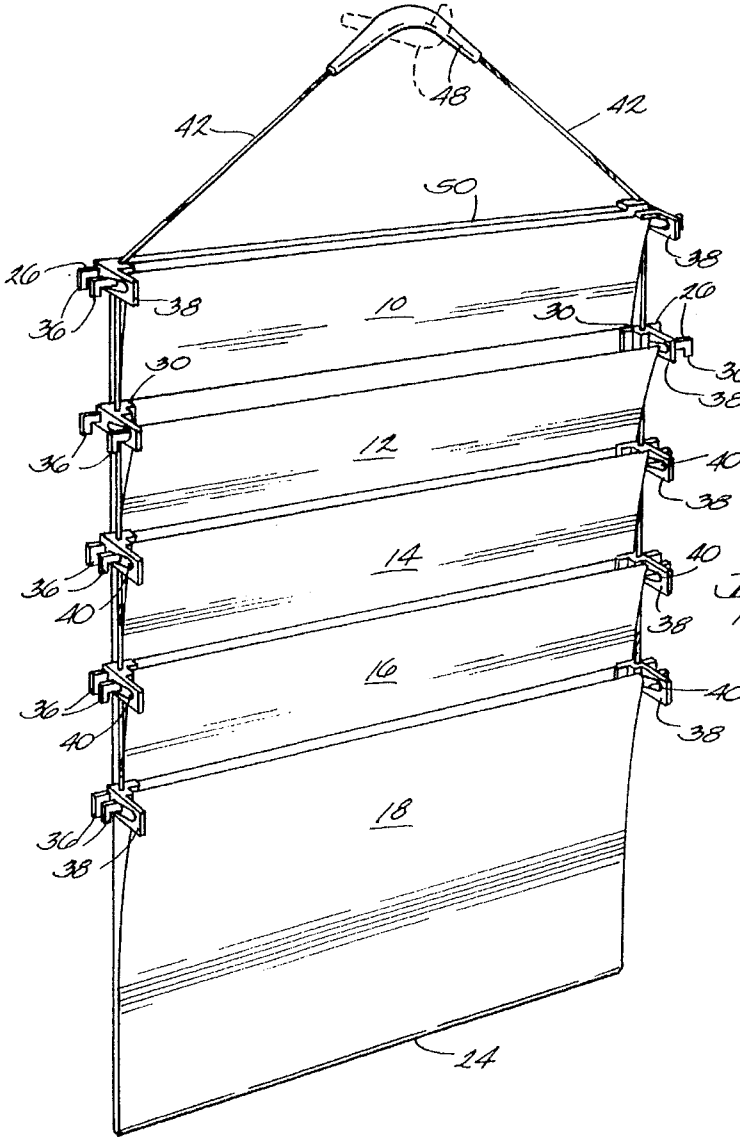
FIG. 1 is a perspective view of an assembly of files incorporating the invention enabling the files to be hung on a vertical surface in a vertically overlapping manner.

The support members 30 are mounted on a flexible wire 42 which runs through the hole 44 in each member and stops 46 are crimped on the wire below each support member to establish the position of the member (and therefore the associated file) on the wire. Wire 42 is continuous from one side to the other and is preferably provided with the plastic handle/hanger 48 which facilitates carrying the assembly of files and their contents and which can establish the center point for hanging purposes. When hung on a wall, door or what have you the files will be vertically spaced on an overlapping manner as illustrated in FIG. 1. The top front edge of each file is exposed so labels thereon can be read easily. Filed materials without folders also may be placed perpendicularly in the hanging files so that the top 1" or so is visible when hanging files are used in their extended position. This makes the files much more useful than when in a file drawer and makes the files to also serve as a display. The wire exerts force on the upper corners of the top file tending to push the corners towards each other. To prevent this from happening the top edge of the rear panel of the upper file is fitted with a stiffening bar 50 which is positioned between the supports 30 or can be made integral with such supports. The stiffening bar slides over and grips the upper edge of the rear panel.

Figure 7:
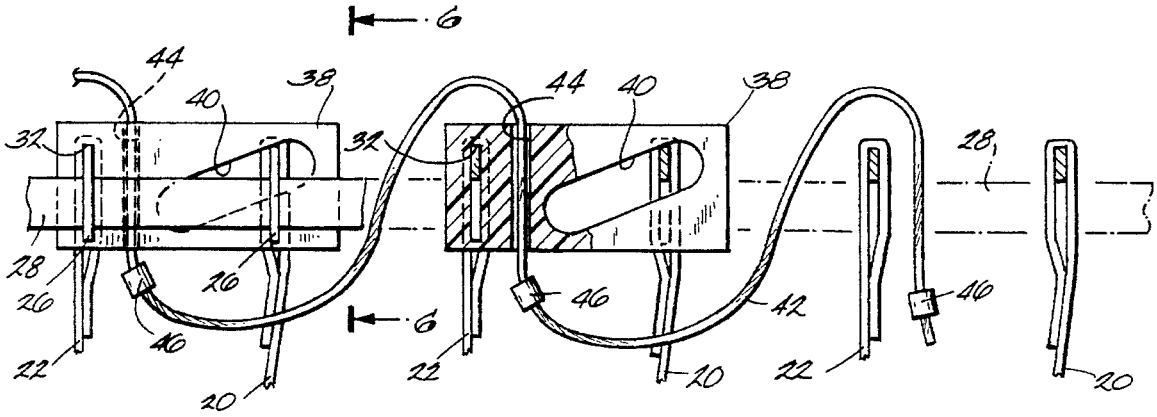
Figure 6:
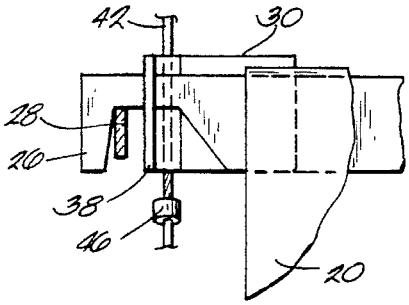
FIG. 6 is a detail view taken as indicated by line 6—6 in FIG. 7 and shows the manner in which the support member engages (rests on) a bar in a file cabinet of the like, FIG. 7 is an end view, partly in section, to illustrate how the hanging wire permits interconnected files to be supported in a file cabinet in a normal way.

When desired, the interconnected files can be placed in a file drawer with the hooks 26 resting on the rails 28 in the normal way but with the flexible wire 42 assuming whatever position is natural, as shown in FIG. 7. The wire does not interfere with normal file storage.

The present invention can be used with pendant files which have front and rear panels interconnected by gussets and are provided with only one hanging hook at each upper corner of the file. In such a case only one support member 30 need be provided at each corner but this would lose the self closing feature provided by having the front hook mounted in the downwardly inclined slot/ramp 40.

We claim:

1. The combination with pendant files of the type having heavy paper stock folders having generally rectangular front and back panels each of which has upper and lower edges hinged to one another at said lower edges, each of said panels also having upper front and rear corners, said front and back panels being provided with downwardly opening front and rear hook means respectively which are to be placed over supports in a file storage facility, means enabling a plurality of said folders to be suspended on a vertical surface in a vertically overlapping manner affording easy viewing of the upper edges of each folder and easy access to an interior of each folder, said enabling means comprising, support means connected to each of said rear hook means and including means receiving the adjacent front hook means, means flexibly interconnecting all said support means on each side of a group of file folders and including a central hanging point on the portion of said interconnecting means which extends between said upper corners of the file which is uppermost when the files are hung on a vertical surface, and stop means mounted on said interconnecting means to limit downward movement of each said support means to provide for vertical spacing between the files.

2. The combination of claim 1 in which said means receiving said adjacent front hook means comprises a slot in said support means, said slot allowing said adjacent front hook means to move closer to or farther from said back panel.

3. The combination of claim 2 in which said slot is downwardly inclined towards said back panel.

4. The combination of claim 3 in which said means flexibly interconnecting said support means comprises a wire which passes through each of said support means.

5. The combination of claim 1 including a stiffening member mounted on the upper edge of the back panel of the uppermost of said file folders between said support means to prevent movement of said upper rear corners of said uppermost file towards each other.

6. The combination with pendant files of the type having heavy paper stock folders having generally rectangular front and back panels each of which has upper and lower edges hinged to one another at said lower edge, each of said panels having upper corners, downwardly opening hook means mounted on said upper corners whereby said hook means may be placed over supports in a file storage facility, means enabling a plurality of said folders to be suspended on a vertical surface in an overlapping manner affording easy viewing of the upper front edge of each folder and easy access to the interior of each folder, said enabling means comprising, support means connected to said upper corners, means flexibly interconnecting all said support means on each side of a group of file folders and including a central hanging point on the portion of such interconnecting means which extends between said upper corners of the file which is uppermost when the files are hung on a vertical surface, and stop means mounted on said interconnecting means to limit downward movement of each said support means to provide for vertical spacing between the files.

* * * * *